US005791004A

United States Patent [19]

Hammadi

[11] Patent Number: 5,791,004

[45] Date of Patent: Aug. 11, 1998

[54] FLOOR CLEANING DEVICE

[75] Inventor: Chafiq Hammadi, Courbevoie, France

[73] Assignee: Colgate-Palmolive Company, New York, N.Y.

[21] Appl. No.: 404,389

[22] Filed: Mar. 14, 1995

[51] Int. Cl.[6] ..... A47L 11/62; A47L 11/24

[52] U.S. Cl. ..... 15/49.1; 15/98; 280/43

[58] Field of Search ..... 15/49.1, 50.1, 15/52, 78, 87, 98, 354, 355, 356; 280/11, 43, 43.17

[56] References Cited

U.S. PATENT DOCUMENTS

| | | | |
|---|---|---|---|
| 1,081,340 | 12/1913 | Spangler . | |
| 1,343,268 | 6/1920 | Kopplin . | |
| 1,663,364 | 3/1928 | Adams . | |
| 1,741,709 | 12/1929 | Orr . | |
| 1,891,175 | 12/1932 | Petersen . | |
| 2,675,246 | 4/1954 | Arones . | |
| 3,000,647 | 9/1961 | Fox . | |
| 3,038,736 | 6/1962 | Root | 280/43.17 |
| 3,147,987 | 9/1964 | Ritums . | |
| 3,421,776 | 1/1969 | McCoy et al. . | |
| 3,649,828 | 3/1972 | Price . | |
| 4,756,042 | 7/1988 | Genovese | 15/98 |
| 4,845,798 | 7/1989 | Genovese . | |
| 4,955,103 | 9/1990 | Scott et al. . | |

FOREIGN PATENT DOCUMENTS

| | | | |
|---|---|---|---|
| 0273703 | 10/1964 | Australia | 15/49.1 |
| 1089958 | 3/1955 | France . | |
| 270205 | 8/1950 | Switzerland . | |
| 383147 | 11/1932 | United Kingdom . | |
| 2166945 | 5/1986 | United Kingdom | 15/98 |
| 2268393 | 1/1994 | United Kingdom | 15/98 |

*Primary Examiner*—Randall E. Chin
*Attorney, Agent, or Firm*—Michael McGreal

[57] ABSTRACT

The floor cleaning machine is designed for both side-to-side and for linear straight path operation. This is accomplished by having at least one recessed rear transport wheel and at least one side-mounted support wheel. The rear transport wheel is recessed and is used for floor machine transport. The side-mounted wheels are adjustable in a rotatable or a vertical plane and are used in a lowered orientation to support the floor cleaning machine for straight path operation. These side-mounted wheels are in a raised position when the floor cleaning machine is to be used in a side-to-side cleaning operation. Thus the position of the side-mounted wheels determine the mode of operation of the floor cleaning machine. Whether used for straight ahead operation or side-to-side operation, the recessed transport wheels will be used to move the floor cleaning machine from location to location.

7 Claims, 5 Drawing Sheets

FLOOR CLEANING DEVICE

BACKGROUND OF THE INVENTION

This invention relates to a floor cleaning device that can be used to clean floors in at least two modes. More particularly, this invention relates to a floor cleaning machine that can be used in a forward path direction or in a side to side direction.

A common type of floor cleaning machine is a single disk machine. This is a machine where a single disk rotates at from about 150 rpm to 1500 rpm. The disk can be a metal or plastic wool disk, a brush disk or a fabric disk. The various disks are used for different purposes. A metal or plastic wool disk would be used for the heavy cleaning of a hard surface floor and for the removal of wax. Fabric disks would be used for light cleaning and polishing. Brush disks would be used for hard surface floor cleaning and carpet shampooing. The machines that use these disks are designed for either side to side operation or straight line operation. In a side-to-side operation, the floor cleaning machines will usually have two rear transport wheels that are recessed above the plane of the disk. As transport wheels, these wheels are used to move the floor cleaning machine from one place to another. They are not used during cleaning. The machine handle is tilted downwardly until the floor cleaning machine rests on the transport wheels. The floor cleaning machine then can be moved to another location. In side-to-side use only the disk contacts the floor so the machine can be moved from side-to side by the operator.

The other type of floor cleaning machine is a forward path floor cleaning machine. This will move forward or at an angle to the forward direction. This type of floor cleaning machine has at least two rear wheels and at least one forward steering wheel. During use the floor cleaning machine is supported on all wheels and moves forward on all wheels. It is steered by means of the rotatable forward wheel or wheels. This type of floor cleaning machine is used to clean floors using a linear path.

The prior art with regard to floor cleaning machines is illustrated by U.S. Pat. Nos. 1,891,175; 2,675,246 and 4,845,798. In U.S. Pat. No. 1,891,175 there is used a rear mounted adjustable set of wheels. These are in a lowered position when the device is used as a vacuum cleaner. In U.S. Pat. No. 2,675,246 there is likewise a rear mounted set of adjustable wheels. These can be raised and lowered depending on the use. U.S. Pat. No. 4,845,798 discloses a rear mounted set of adjustable wheels on a floor polishing machine. All of these references disclose the use of rear mounted wheels. In the floor cleaning machine of this application the wheels are side mounted so as to be better able to control the machine.

One problem with these prior art floor cleaning machines is that usually a different machines are needed for different uses. The present invention is an improvement in floor cleaning machines where a single machine can be used for either side-to-side use or linear use in floor cleaning. This is accomplished by the use of a particular arrangement of wheels. This results in a more efficient floor cleaning machine. Since only one machine is needed, there is a decreased capital cost. There is a decreased operating cost since only one machine must be stored and maintained. Also the present arrangement of wheels provides for a maximum control over the machine. This is particularly important since the pad will be rotating at about 500 to 1500 rpm and usually at about 1,000 rpm.

BRIEF SUMMARY OF THE INVENTION

The problems of the prior art floor cleaning machines are solved by the present floor cleaning machine. A single machine can be used for side-to-side operation or for straight ahead operation by a floor cleaning machine that has at least two adjustable wheels mounted at the sides of the floor cleaning machine.

The floor cleaning machines will usually be of a single disk type, although they can also be of a dual disk type. The disk can be of a metal or plastic wool, brush or fabric type. The disk can rotate at about 500 to 1500 rpm.

The side mounted wheels can be adjusted by rotating about a mounting pin and locking the wheel into place at a particular rotation. The wheels can also be adjusted by a vertical movement of the wheel mounting pin upwardly and downwardly. The mounting pin is locked into position by a locking pin or a friction engagement. In addition these wheels can be adjusted hydraulically, pneumatically or electrically.

DETAILED DESCRIPTION OF THE INVENTION

The present floor cleaning machine can be used in a forward movement cleaning mode or in a side-to-side cleaning mode. This is accomplished by the use of at least one adjustable wheel mounted on each side of the machine.

Figure 1:
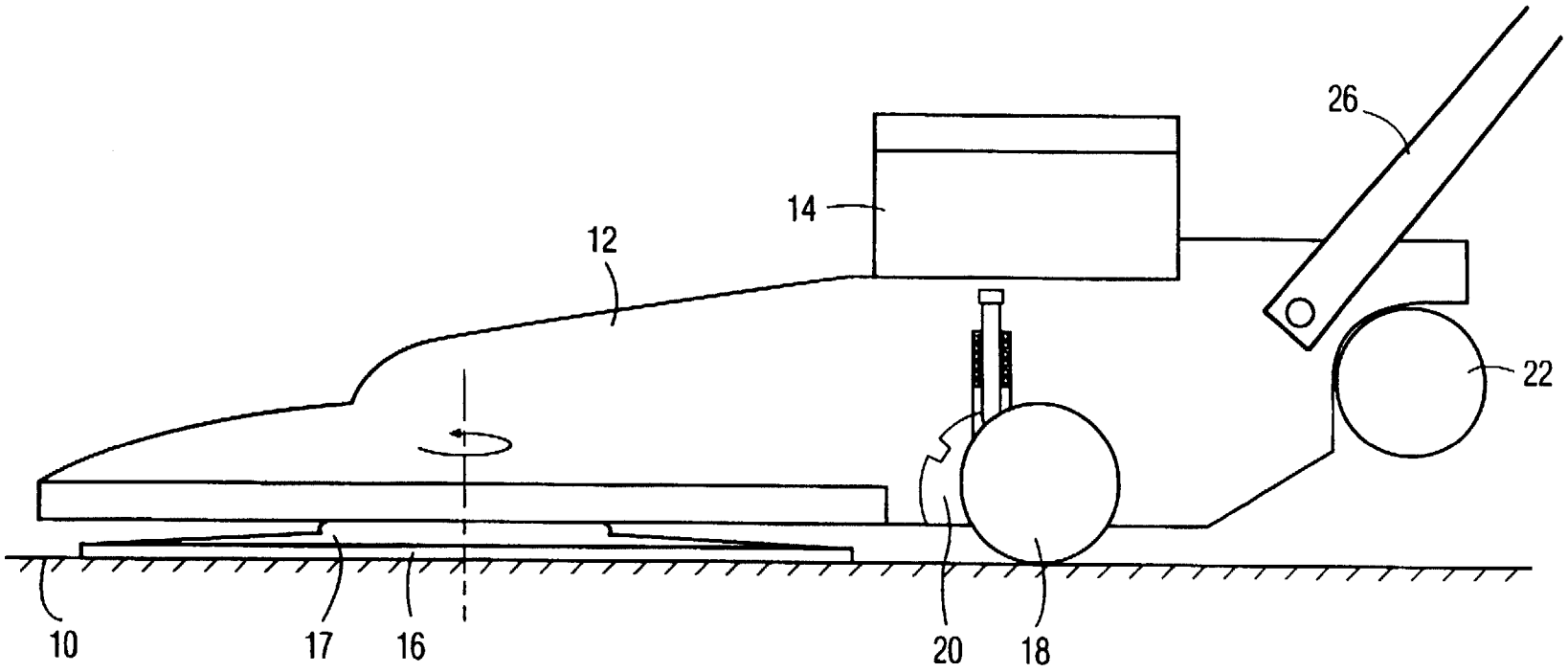
FIG. 1 is a side elevational view of the floor cleaning machine with the side mounted support wheels in a lowered position.

In FIG. 1 the floor cleaning machine is shown in a mode for straight forward motion, the side mounted wheels 18 being in a lowered position so that the floor cleaning machine is supported on the floor 10 by the rotating pad 16 and the side mounted wheels 18. The motor 14 drives the pad 16 by means of a belt drive. The pad 16 is attached to pad support 17 which is mounted to the floor cleaning machine housing 12. A shaft extends upwardly from pad support 17 and is rotated by a belt extending from a shaft on motor 14. At the rear of the housing 12 there are one or more transport wheels 22. These wheels can be of a width of from 2 to 15 centimeters. When a larger width, there need be only one roller type of transport wheel. Preferably there will be two transport wheels, each being about 2 to 5 centimeters in width.

The side mounted wheels 18 are adjustable by means of fixed housing bracket 20 for each of the side mounted wheels. This adjustable mechanism is shown in more detail in FIG. 4.

Figure 2:
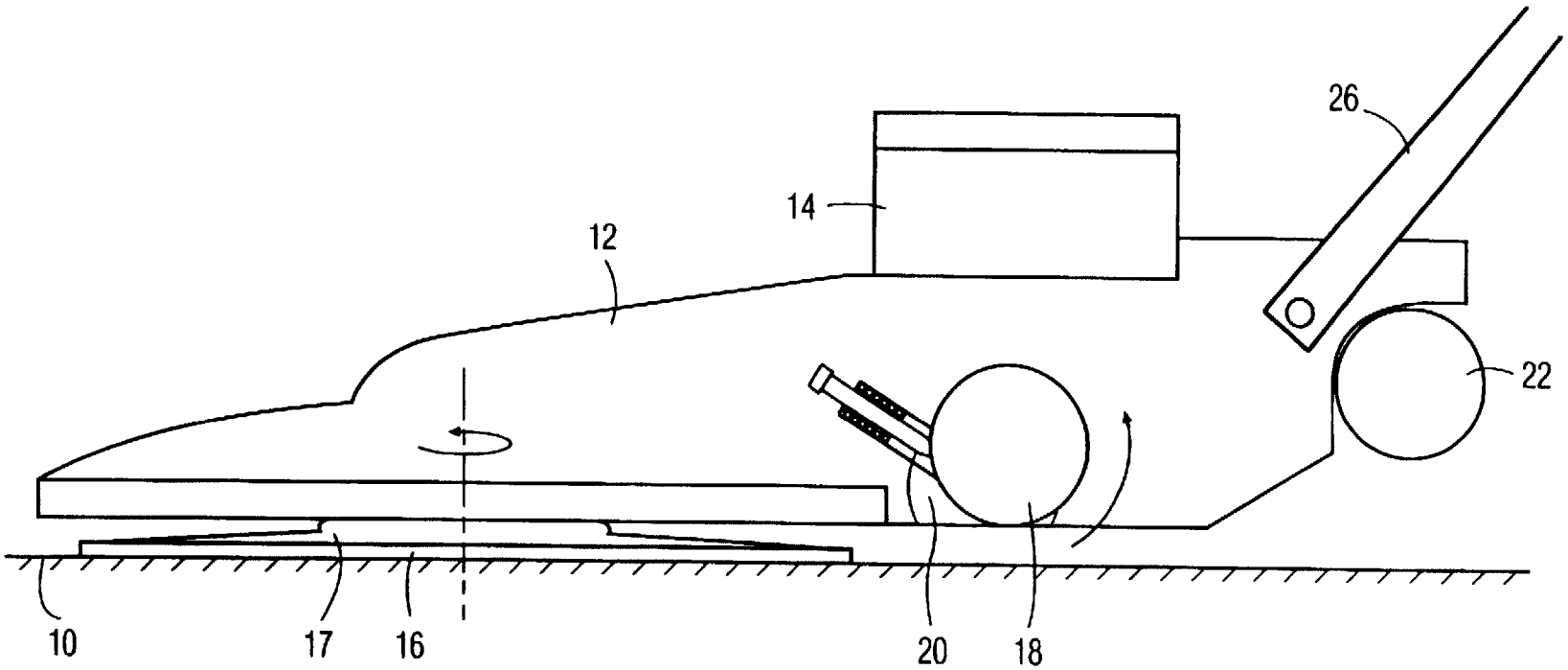
FIG. 2 is a side elevational view of the floor cleaning machine with the side mounted support wheels in a raised position.

In FIG. 2 the floor cleaning machine is shown set-up for a side-to-side mode of operation. In this view, the side mounted adjustable wheels 18 are in a raised position so that they are out of contact with the floor. With the side mounted wheels in this position, the floor cleaning machine can be moved in a side-to-side operation by the operator.

Figure 3:
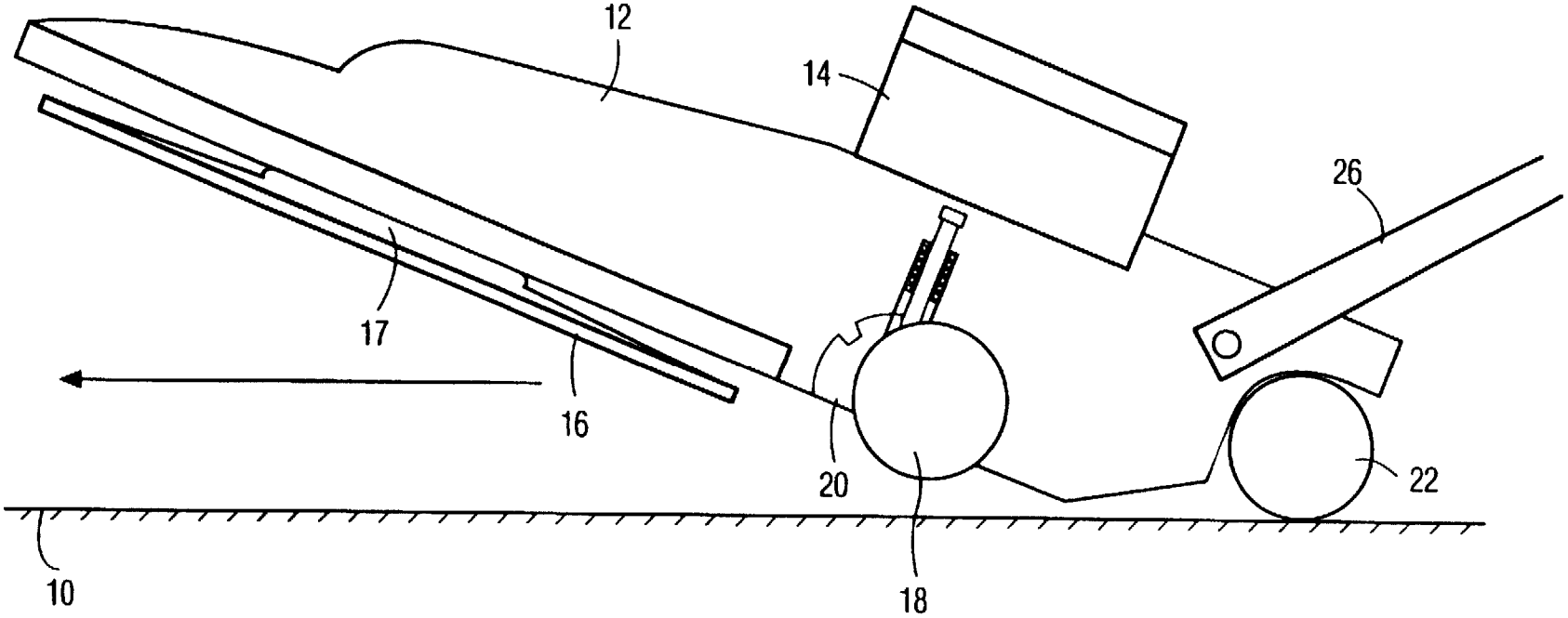
FIG. 3 is a side elevational view of the floor cleaning machine in a transport mode.

FIG. 3 shows the floor cleaning machine in a transport mode. In this mode, the housing 12 is tilted backward by the operator by means of handle 26. In this mode, the floor cleaning machine rests on transport wheels 22 and can be moved to another location.

Figure 4:
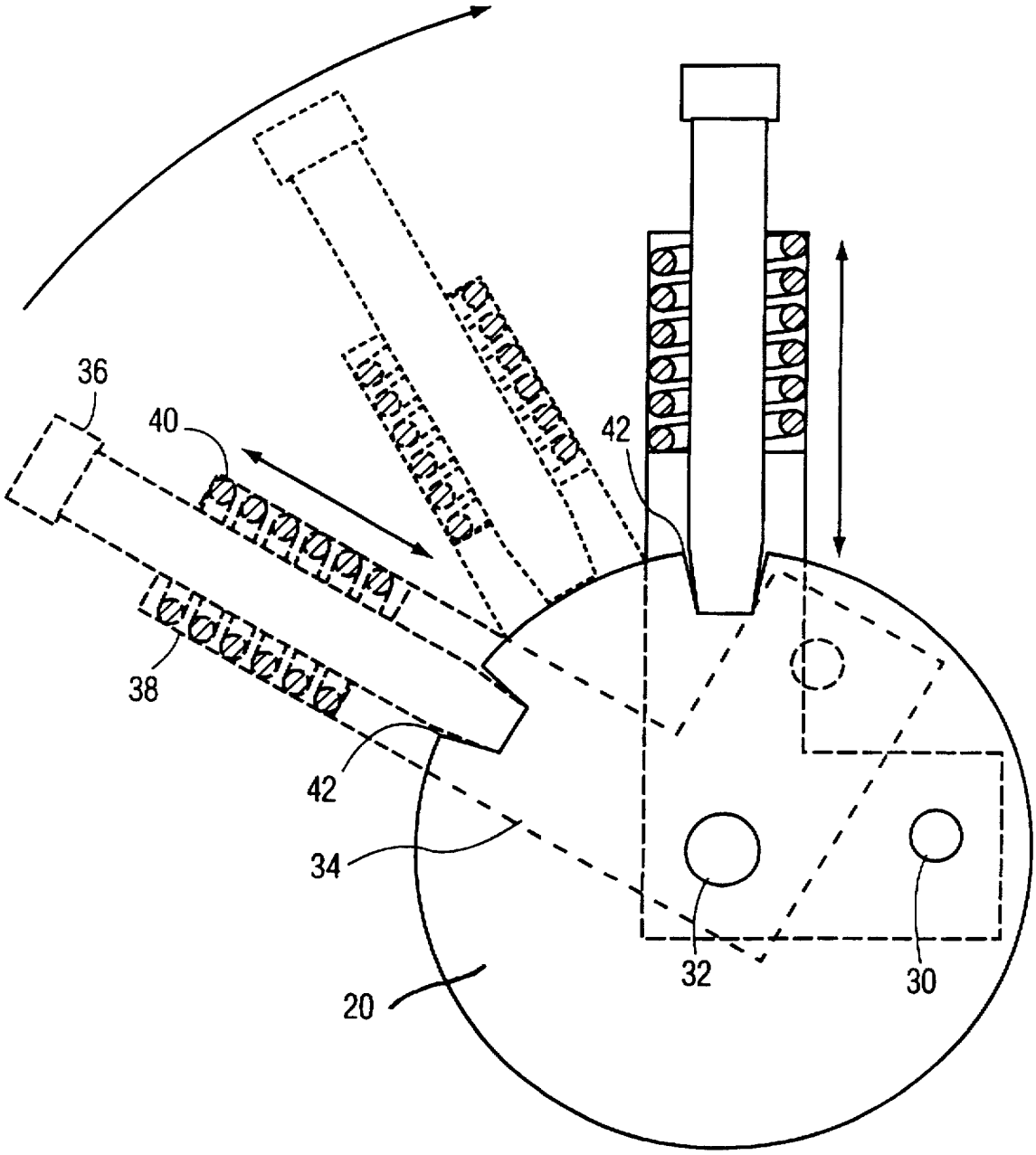
FIG. 4 is a side elevational view of a rotatable support wheel adjustment mechanism.

FIG. 4 describes one type of bracket for adjusting side mounted wheels 18. The mechanism consists of fixed housing bracket 20 and cooperating wheel bracket 34. Housing bracket is rigidly mounted to housing 12. Wheel bracket 34 is attached to the housing bracket by bracket axle 32 which can be a screw and bolt axle arrangement. The wheel axle 30 holds wheel 18 and attaches this wheel to wheel bracket 34. Mounted on wheel bracket 34 is pin 36 which slidingly fits into channel 38 of the wheel bracket. Spring 40 biases the pin downwardly. The lower part of pin 36 fits into one of the grooves 42 of housing bracket 20 to lock the adjustable wheel in a raised or lowered position.

Figure 5:
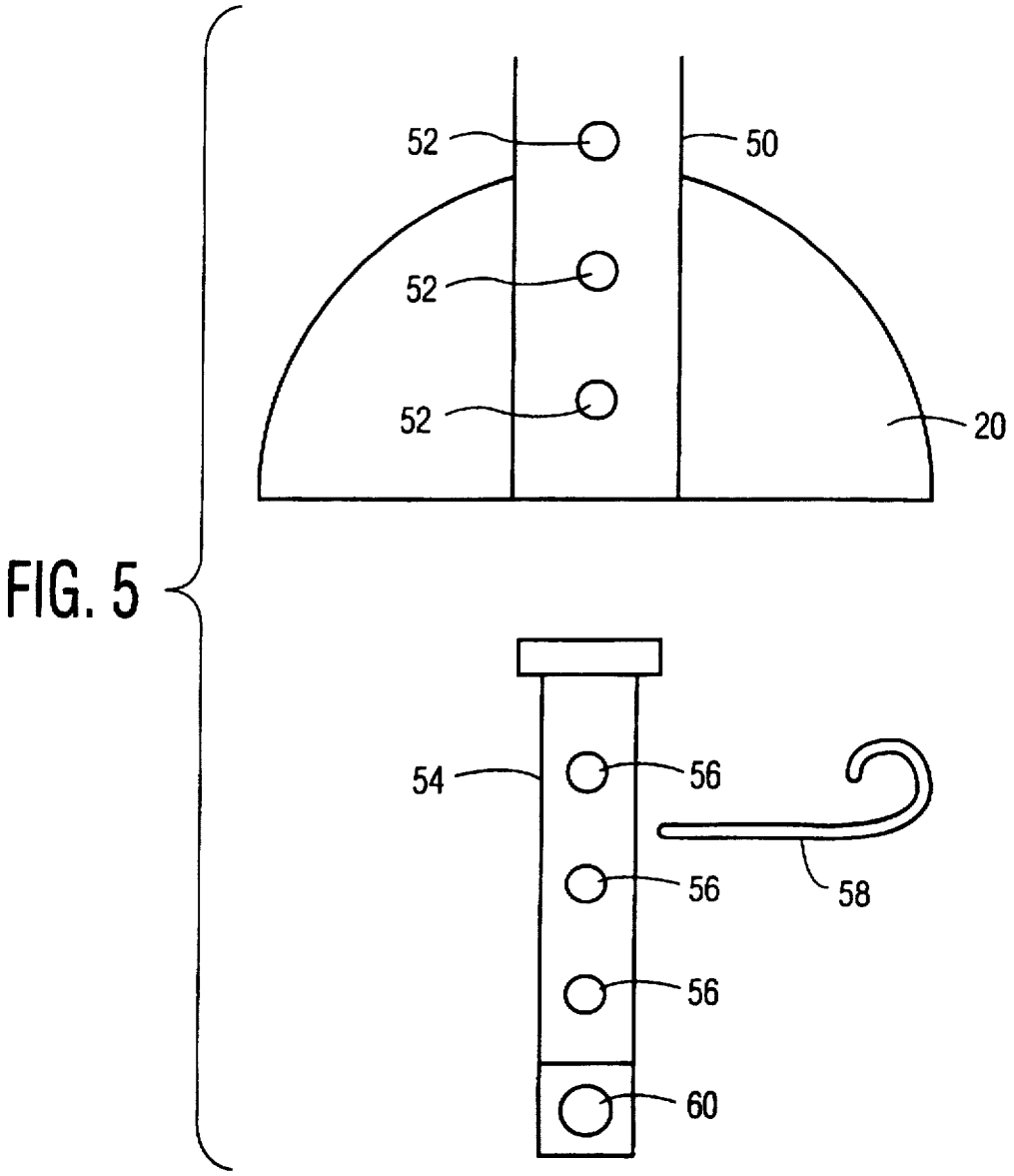
FIG. 5 is a side elevational view of a vertical support wheel adjustment mechanism.

FIG. 5 shows an alternate structure for adjusting the side wheels. The bracket 20 has attached channel 50 which has aperture 52. Pin 54 which has aperture 56 fits into channel 50. At the bottom of pin 54 is wheel axle aperture 60. Locking pin 58 is used to lock the pin 54 in a designated position by passing through an aperture 52 and an aperture 56. In addition to this structure for adjusting the wheels, the wheels can be adjusted hydraulically, pneumatically or electrically.

In use a mode of operation of the floor cleaning machine is chosen. If the mode is side-to-side, the floor cleaning machine is transported to the use site on transport wheels 22. The side mounted wheels are adjusted to the raised position and the floor cleaning machine operated. If on the other hand a straight path operation is desired, the side mounted wheels 22 are adjusted to a lowered position and the floor cleaning machine used by rolling on the side mounted wheels. The rotating pad will be in contact with the floor in each mode of use.

The adjustable wheels are side mounted for increased control over the floor cleaning machine when used in a straight path position. Since the rotating disk is contacting the floor, the control and stability of the machine is increased by having the wheels side mounted and adjacent to the rear of the rotating disk rather than at the rear of the floor cleaning machine. This reduces the torquing of the machine as a result of the rotation of the disk. Also these wheels should be mounted within the profile of the motor which is one of the heavier components of the floor cleaning machine. This maximizes the downward force of the machine onto the wheels and increases its stability in straight ahead use.

In preferred use, the floor cleaning machine will be of the single disk type. The pad will rotate at about 500 to 1500 rpm, and preferably about 1000 rpm. The pads can be a metallic or plastic wool type, a brush type or a fabric pad type. The type of cleaning to be done will determine the type of pad to be used. The pad in a preferred use will be about 505 mm in diameter.

In addition, the floor cleaning machine can be of a type that dispenses a liquid as it is operated. In such instances, the floor cleaning machine will have a sump that contains the liquid. The liquid is discharged from the sump by the floor machine operator.

This sets out the preferred embodiments of the floor cleaning machine. Various modifications can be made but such modifications would be within the bounds of the disclosed invention.

I claim:

1. A floor cleaning apparatus having at least one rotatable disk, a drive motor to rotate said at least one rotatable disk and a housing having a lower portion and at least one side surface comprising said at least one rotatable disk mounted on said lower portion of said housing and extending to a point below said housing, said drive motor on said housing to rotate said disk, and at least one adjustable support wheel attached to said at least one side surface whereby during use in a straight path direction a floor is contacted by said at least one rotatable disk and said at least one adjustable support wheel, and in use in a non-straight path said floor is contacted solely by said rotatable disk.

2. A floor cleaning machine as in claim 1 wherein said at least one support wheel is adjustable to move said at least one support wheel upwardly out of contact with said floor whereby the floor cleaning apparatus is supported solely by said disk.

3. A floor cleaning apparatus as in claim 2 wherein there is at least one fixed bracket on at least one side of said housing and a cooperating wheel bracket on said at least one support wheel, a fixed bracket axle connecting said cooperating wheel bracket to said at least one fixed bracket, a cooperating wheel bracket axle connecting said cooperating wheel bracket to said at least one support wheel and a locking means on said cooperating wheel bracket to lock said cooperating wheel bracket into a position on said at least one fixed bracket when said cooperating wheel bracket is rotated about said cooperating bracket axle.

4. A floor cleaning apparatus as in claim 3 wherein said locking means comprises a plurality of grooves on said at least one fixed bracket and a spring biased pin on said cooperating wheel bracket which can fit into each of said plurality of grooves.

5. A floor cleaning apparatus as in claim 1 wherein said housing has at least one transport wheel recessed into said housing.

6. A floor cleaning apparatus as in claim 1 wherein said housing has a rear surface portion, said at least one transport wheel recessed in said rear surface portion of said housing.

7. A floor cleaning apparatus having at least one rotatable disk, a drive motor to rotate said at least one rotatable disk and a housing having a lower portion and at least one side surface comprising said at least one rotatable disk mounted on said lower portion of said housing and extending to a point below said housing, said drive motor on said housing to rotate said disk, at least one adjustable support wheel attached to said at least one side surface and being moveable downwardly to contact said floor and upwardly out of contact with said floor whereby said floor cleaning apparatus is supported solely by said disk, at least one fixed bracket on said housing and a cooperating wheel bracket attached to said at least one support wheel, said at least one fixed bracket having an upwardly extending channel, said channel having a plurality of apertures therethrough, a rod attached to said cooperating wheel bracket and slidingly fitting into said channel, said rod having a plurality of apertures therethrough, whereby upon alignment of a channel aperture and a rod aperture, a locking pin can be inserted therethrough to maintain said at least one support wheel in position, further whereby during use in a straight path direction a floor is contacted by said at least one rotatable disk and said at least one adjustable support wheel and in use in a non-straight path said floor is contacted solely by said rotatable disk.

* * * * *